US010376014B2

(12) United States Patent
Apostolopoulos et al.

(10) Patent No.: US 10,376,014 B2
(45) Date of Patent: Aug. 13, 2019

(54) SHOE COVER WITH BISTABLE LATCH

(71) Applicant: CleatGuard LLC, Barrington, IL (US)

(72) Inventors: Xristos K. Apostolopoulos, Barrington, IL (US); Katharine C. Mena, Barrington, IL (US); Laura Mena, Barrington, IL (US); Andréa Potgieter, Barrington, IL (US)

(73) Assignee: CleatGuard LLC, Barrington, IL (US)

( * ) Notice: Subject to any disclaimer, the term of this patent is extended or adjusted under 35 U.S.C. 154(b) by 207 days.

(21) Appl. No.: 15/257,154

(22) Filed: Sep. 6, 2016

(65) Prior Publication Data

US 2018/0064200 A1 Mar. 8, 2018

(51) Int. Cl.

| | |
|---|---|
| ***A43B 3/18*** | (2006.01) |
| ***A43B 13/14*** | (2006.01) |
| ***A43B 13/18*** | (2006.01) |
| ***A43B 13/04*** | (2006.01) |
| ***A43C 15/02*** | (2006.01) |
| ***A43B 5/18*** | (2006.01) |
| *A43C 15/00* | (2006.01) |

(52) U.S. Cl.

CPC ..... *A43B 3/18* (2013.01); *A43B 5/18* (2013.01); *A43C 15/02* (2013.01); *A43C 15/00* (2013.01)

(58) Field of Classification Search

CPC .. A43B 3/18; A43B 5/18; A43C 15/02; A43C 15/00

See application file for complete search history.

(56) References Cited

U.S. PATENT DOCUMENTS

| | | | | | |
|---|---|---|---|---|---|
| 1,406,657 | A | * | 2/1922 | Knizek | A43C 15/02 36/132 |
| 1,540,646 | A | * | 6/1925 | Newhouse | A43B 3/18 36/58.5 |
| 1,748,607 | A | * | 2/1930 | Jarrett | A43B 5/18 2/61 |
| 1,964,280 | A | | 6/1934 | Witchge | 33/768 |
| 2,824,035 | A | | 2/1958 | Donald | 156/305 |
| 3,566,488 | A | | 3/1971 | Pilarski | 36/7.5 |
| 3,609,888 | A | * | 10/1971 | Rickman | A43B 3/26 36/130 |
| 3,821,858 | A | | 7/1974 | Haselden | 36/135 |
| 4,702,020 | A | | 10/1987 | Kroeger | 36/11.5 |
| 4,807,372 | A | * | 2/1989 | McCall | A43B 5/14 36/131 |
| 5,628,069 | A | | 5/1997 | Ebert | 2/161.1 |
| 5,794,386 | A | | 8/1998 | Klein | 52/91.1 |

(Continued)

*Primary Examiner* — Jila M Mohandesi

(74) *Attorney, Agent, or Firm* — Niro McAndrews, LLP

(57) ABSTRACT

Disclosed is an improved shoe cover with a bistable latch that allows for easy securing and removal of the shoe cover while providing a strong connection between the shoe and the shoe cover when in use. The shoe cover includes at least one bistable spring band at or around the toe, midsection, or heel of the cover for securing the cover to the shoe. In addition, a secondary attachment mechanism may be employed as well, which may include: a string-like material to encircle the shoe about its center, a semi-rigid structure on the inner-side of the cover; and/or an impressionable material located on or within the inner-side of the cover, so that it is directly exposed to the specialized shoe. The impressionable material will create a mold that is at least partially impermanent, permanent or semi-permanent.

20 Claims, 21 Drawing Sheets

(56) References Cited

U.S. PATENT DOCUMENTS

| | | | | |
|---|---|---|---|---|
| 5,842,290 | A * | 12/1998 | Mills | A43B 3/16 36/7.5 |
| 6,154,982 | A | 12/2000 | Bell | 36/7.6 |
| 6,846,379 | B1 | 1/2005 | Bove | 156/272.4 |
| 6,968,634 | B2 * | 11/2005 | Dombowsky | A43B 3/163 36/11.5 |
| 6,988,328 | B2 | 1/2006 | Rosen | 36/7.1 R |
| 7,152,340 | B2 * | 12/2006 | Issler | A43B 1/0081 36/15 |
| 7,188,438 | B1 | 3/2007 | Bowen | 36/7.1 R |
| 7,222,440 | B2 * | 5/2007 | Dombowsky | A43B 3/16 36/11.5 |
| 7,779,560 | B2 | 8/2010 | Kay | 36/135 |
| 7,827,707 | B2 | 11/2010 | Davis | 36/71 |
| 8,225,529 | B2 | 7/2012 | Simms | 36/7.1 R |
| 8,387,287 | B2 | 3/2013 | Kay | 36/135 |
| 8,453,355 | B2 | 6/2013 | Kay | 36/135 |
| 8,671,588 | B2 | 3/2014 | Hampton | 36/7.1 R |
| 8,813,387 | B2 | 8/2014 | Grove | 36/15 |
| D731,762 | S | 6/2015 | Sanchez | D02/909 |
| 2003/0152731 | A1 | 8/2003 | Deetz | 428/40.1 |
| 2005/0066543 | A1 | 3/2005 | Rosen | 36/7.5 |
| 2006/0101667 | A1 * | 5/2006 | Kane | A43B 3/106 36/9 R |
| 2006/0157888 | A1 | 7/2006 | Mata Diego | 264/223 |
| 2007/0113424 | A1 | 5/2007 | Bell | 36/7.3 |
| 2009/0288314 | A1 | 11/2009 | Kay | 36/91 |
| 2010/0077638 | A1 | 4/2010 | Simms | 36/136 |
| 2011/0252664 | A1 | 10/2011 | Jennings | 36/28 |
| 2012/0036738 | A1 | 2/2012 | Willis | 36/73 |
| 2012/0285045 | A1 | 11/2012 | Tsen | 36/135 |
| 2013/0044215 | A1 | 2/2013 | Rothkopf | 348/143 |
| 2014/0000984 | A1 | 1/2014 | Thornton | 185/37 |
| 2014/0325875 | A1 | 11/2014 | Lee | 36/73 |
| 2015/0213580 | A1 | 7/2015 | Yamano | 345/649 |
| 2015/0230561 | A1 | 8/2015 | Bunch | 36/59 C |

* cited by examiner

FIG. 16
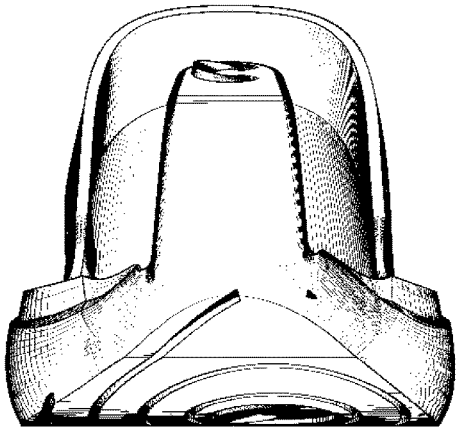
FIG. 18
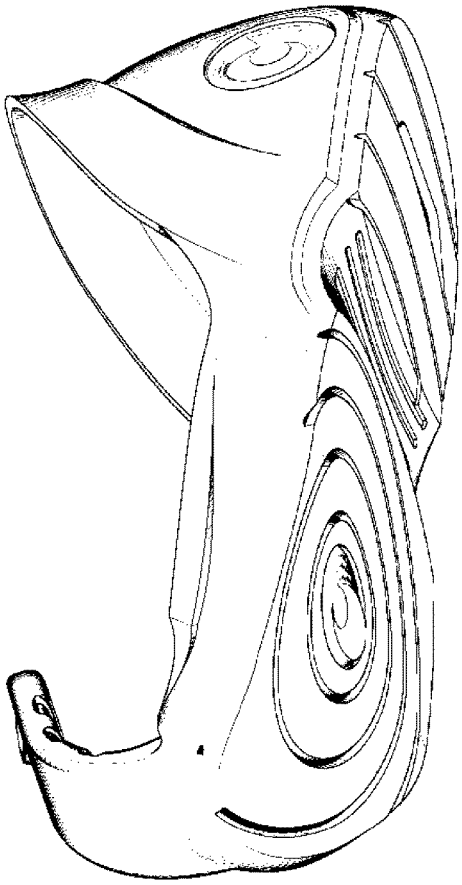
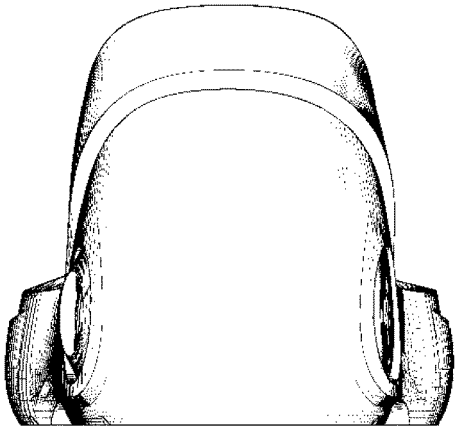
FIG. 17

FIG. 25
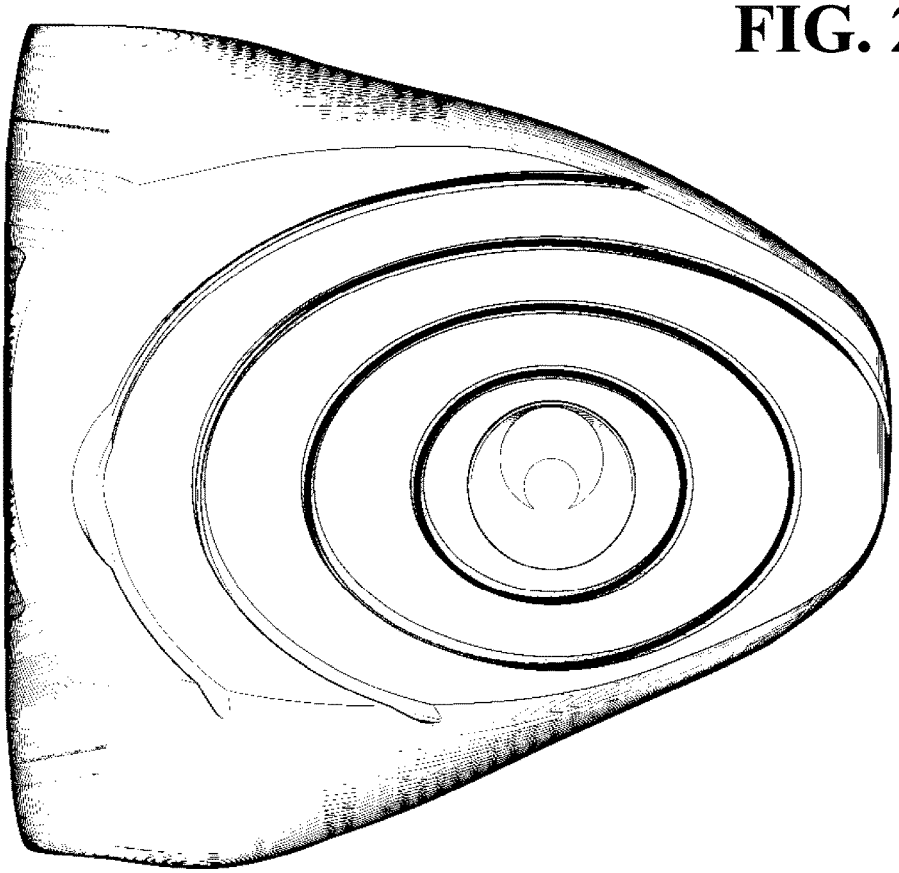
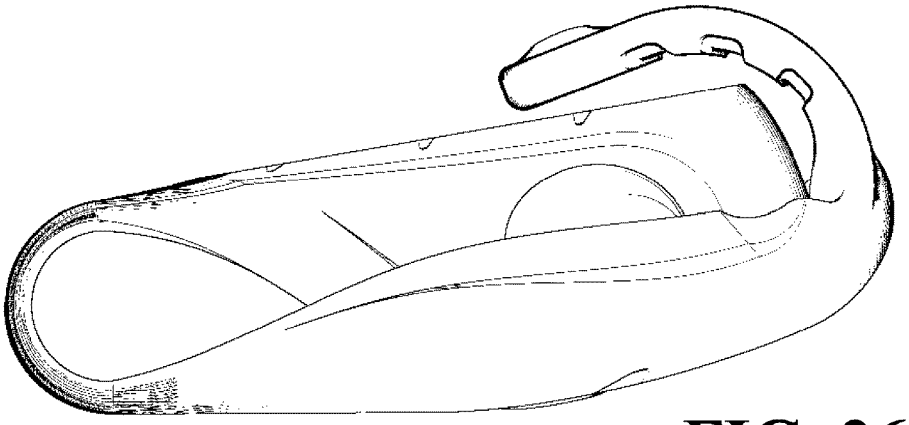
FIG. 26

SHOE COVER WITH BISTABLE LATCH

FIELD OF THE INVENTION

The present invention relates generally to shoe covers and mechanisms for securing shoes in shoe covers.

BACKGROUND OF THE INVENTION

Specific activities often require specialized shoes such as cleated shoes for soccer and baseball, cycling shoes for rode biking, and hard plastic boots for skiing. While these shoes are optimized for their intended use, after the activity is finished these specialized shoes often provide poor traction and will damage and/or soil common flooring such as carpet. Typically the specialized shoes are removed after use in their intended activity, however this requires the user to carry two sets of shoes and also requires the removal of the specialized shoe. Removal of the specialized shoe can be problematic and time consuming if the shoe, such as a ski boot, has numerous fine adjustments and the user intends on returning to the activity in the near future.

Patent Application No. US20120285045 discloses a "removable cleat protector for a cycling shoe having a cleat with particular size and shape attached thereto." However, the item disclosed only covers the cleat of a specialized shoe and it would be difficult for a user to walk in the covered shoe. U.S. Pat. No. 3,566,488 discloses "a shoe cleat protective device that includes a sole portion of flexible material including in its upper surface a plurality of spaced recesses in the pattern of the cleat of a shoe." The U.S. Pat. No. 3,566,488 discloses a shoe cover with a sole pattern that matches the pattern of the specialized shoe. A specialized pattern creates problems when the shoe has mud on it, or if the user replaces the shoe with one having a non-matching cleat pattern.

SUMMARY OF THE INVENTION

The present invention provides an improved shoe cover with a bistable latch that allows for easy securing and removal of the shoe cover while providing a strong connection between the shoe and the shoe cover when in use. The shoe cover includes at least one bistable spring band at or around the toe, midsection, or heel of the cover for securing the cover to the shoe. In addition, a secondary attachment mechanism may be employed as well, which may include: a string-like material to encircle the shoe about its center; a semi-rigid structure on the inner-side of the cover; and/or an impressionable material located on or within the inner-side of the cover. The impressionable material will create a mold that is at least partially impermanent, permanent or semi-permanent.

BRIEF DESCRIPTION OF THE DRAWINGS

FIG. 16 shows a front elevational view of a latched shoe cover.

FIG. 17 shows a rear elevational view of a latched shoe cover.

FIG. 18 shows a lower side perspective view of a latched shoe cover.

FIG. 25 shows a rear elevational view of a latched and folded shoe cover.

FIG. 26 shows a side elevational view of a latched and folded shoe cover.

DETAILED DESCRIPTION

The present invention may be used with any shoe and is particularly suited for covering shoes with specialized features. However, for descriptive purposes the present invention will be described in use with cleated shoes.

Figure 1:
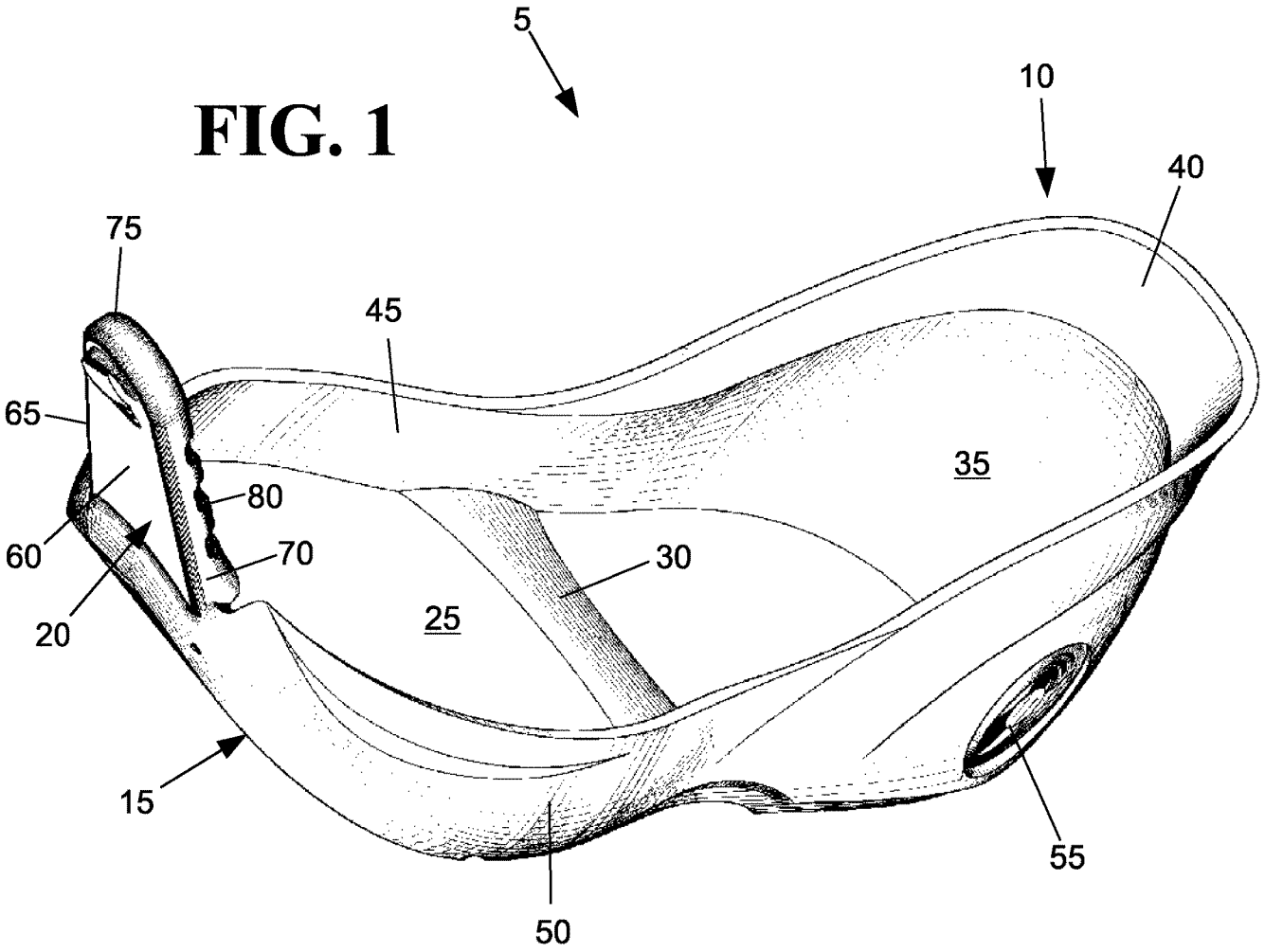
FIG. 1 shows a first upper front perspective view of an unlatched shoe cover.
Figure 2:
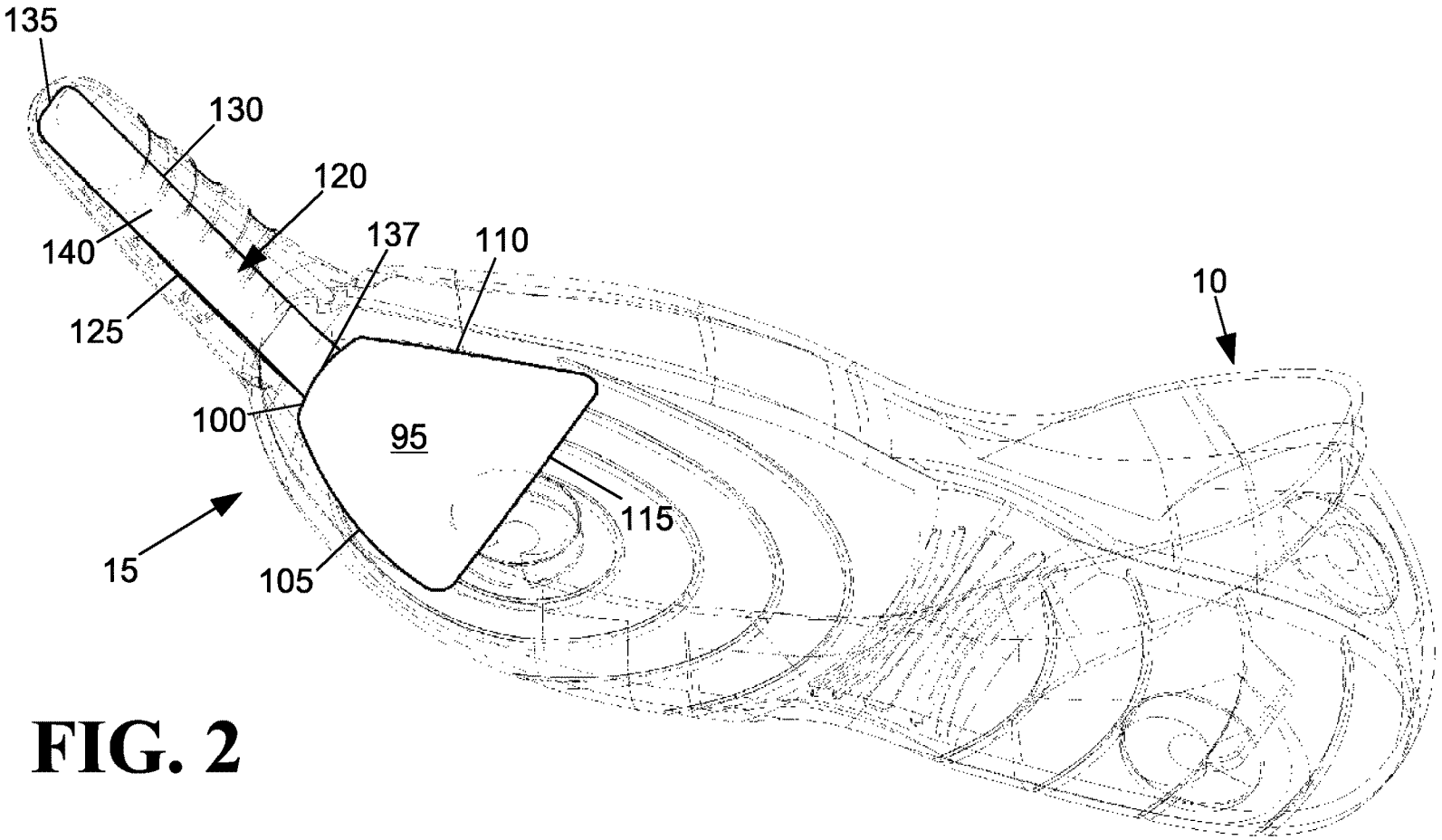
FIG. 2 shows an internal lower perspective view of an unlatched shoe cover.
Figure 4:
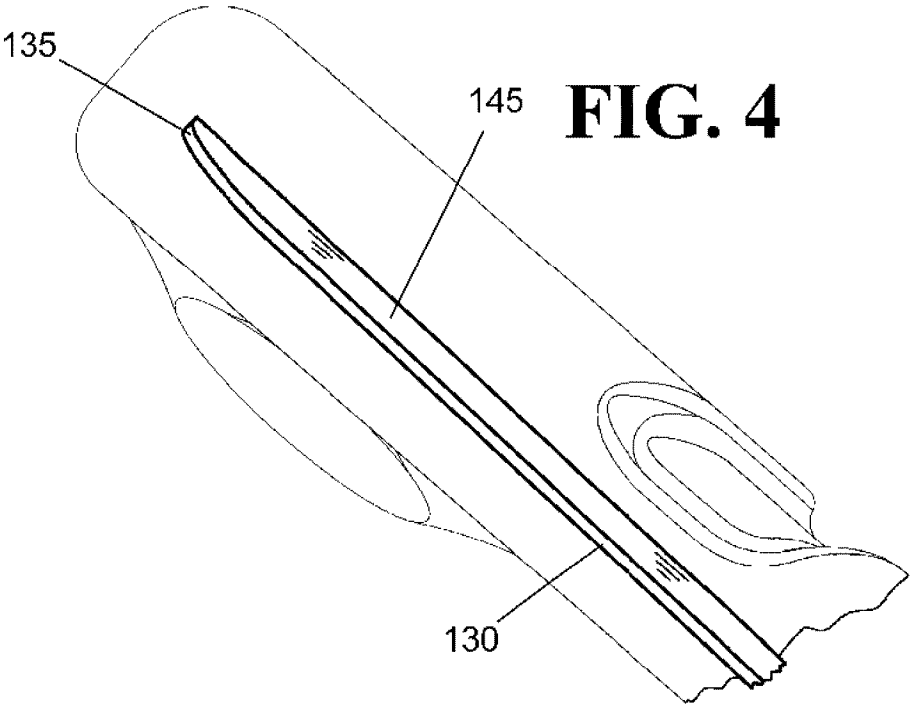
FIG. 4 shows a highlighted portion of the shoe cover of FIG. 2.
Figure 3:
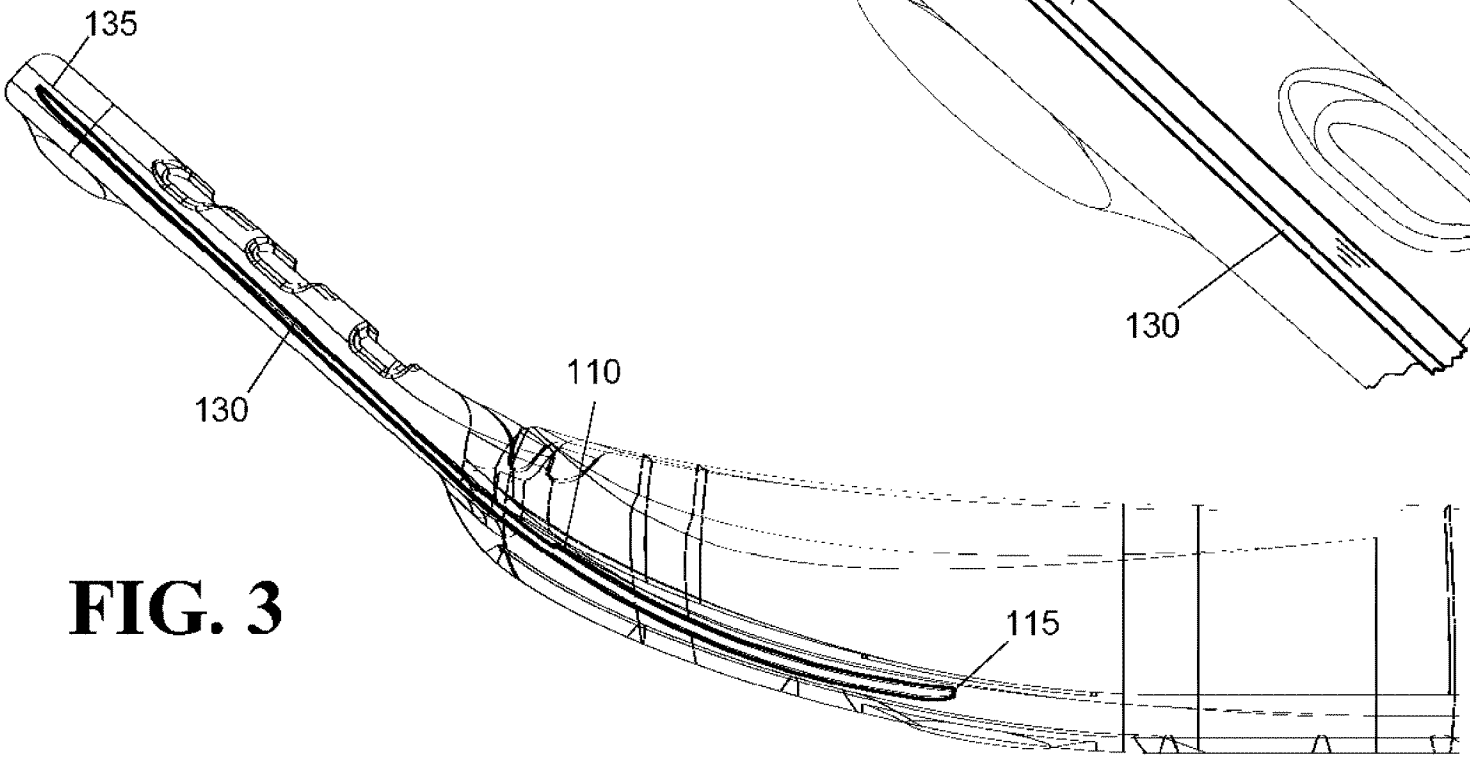
FIG. 3 shows an internal side elevational view of an unlatched shoe cover.

FIG. 1 shows a shoe cover 5 having a heel portion 10, a toe portion 15, and a latching portion 20 extending from the toe portion 15 of the shoe cover 5. The shoe cover includes a sole 25 that extends from the heel portion 10 to the toe portion 15, and in the illustrated example includes an arch 30 that may be complimentary to the arch of a user's shoe. A curved rear wall 35 extends upwards from the sole in the heel portion 10 of the shoe cover 5. As with the arch 30, the rear wall 35 may be sized to be complimentary to a user's shoe. Above the rear wall 35 is a rear band 40 adapted to facilitate a user placing the heel of their shoe into the shoe cover 5. In one embodiment, the rear wall 35 is flexible and adapted to configure to the shape of a user's shoe while the rear band 40 is more rigid and shaped to facilitate a user grasping the rear band to position the rear wall 35. In one embodiment, the rear wall 35 has a concave shape on its interior surface facing the sole 25 that assists in securing the shoe cover 5 to a user's shoe.

Extending forward from the rear wall 35 are a first side wall 45 and a second side wall 50 that are substantially parallel to each other. In the illustrated example, the heights of the side walls (45 and 50) are substantially less than the height of the rear wall 35 because the rear wall 35 and the latching portion 20 are the primary features that secure the shoe cover 5 to the user's shoe. In an alternate embodiment, the side walls (45 and 50) would be substantially taller and more robust to assist in securing the shoe cover to a user's shoe. In an embodiment with tall side walls and a robust arch 30, the rear wall 35 and rear band 40 may be omitted from the shoe cover 5. In such an embodiment, the shoe cover would function similar to a flip-flop type sandal. In the illustrated example, the arch 30 is sufficiently thin and flexible to allow the shoe cover to be folded into compact configuration shown in later illustrations.

In the illustrated example, at the exterior junction of the rear wall 35 and the second side wall 50 there is a textured surface 55 that may be used to scrape mud or dirt from a user's shoe. In addition to having a functional use, the textured surface 55 may be structured to include the logo of the shoe cover manufacturer, a sports team, or a third party advertiser.

The sole 25 of the shoe cover 5 is constructed of a flexible yet resilient material that is able to repeatedly conform to the shapes associated with specialized footwear (such as cleats or spikes) without breaking. Alternate embodiments of the invention may use thicker or thinner soles based upon a variety of factors such as intended use, price of materials, advances in materials, and the composition of materials. For example, in one embodiment, a metal mesh is incorporated into the sole to increase the shoe cover's resistance to being pierced by golf shoe spikes. In yet another embodiment, a thinner sole is used to reduce overall weight of the shoe cover in order to make transport easier. Alternatively, the sole may include perforated sections to allow a user to customize their shoe cover to one or more specialized shoes by selectively removing sections of the sole. In another embodiment, the sole is constructed of a thermosensitive plastic that becomes semi-fluid above a set temperature (170 degrees Fahrenheit, for example) such that a user may create custom indentations by heating the shoe cover and pressing their specialized shoe into the cover while hot.

The latching portion 20 includes an outer surface 60, two rounded side surfaces (65 and 70), a rounded top surface 75, and a slotted inner surface 80. The slots of the inner surface 80 act to facilitate the inward flexing of the latching portion 20 towards the rear wall 35. In the illustrated example the slotted inner surface 80 includes three slots that are substantially horizontal when the shoe cover is on a flat horizontal surface. In alternate embodiments, greater than three or less than three slots may be used on the inner surface of the latching portion 20. In one embodiment, the slots on the inner surface are arranged into a stylized design to enhance the overall appearance of the shoe cover. In yet another embodiment the inner surface is smooth and flat to facilitate cleaning of the shoe cover.

In the illustrated example, at the intersection of the latching portion 20 and the first and second side walls (45 and 50) there are divots 85 or cutouts that act to facilitate the bending of the latching portion 20 by reducing bunching of material at a point of flex.

In the illustrated example shown in FIG. 1, the visible exterior portions of the shoe cover 5 are constructed from a molded plastic or rubber having a substantially uniform consistency. In an alternate embodiment, the shoe covers are constructed from two or more pieces that interlock with each other. In one example, the shoe covers are formed from a front portion that is separable and interlocking with a rear portion. The front portion includes two apertures at approximately the locations indicated by markers 45 and 50 in FIG. 1 while the rear portion includes T-shaped or cross-shaped fasteners that fit through and are securable within the apertures of the front section. Separable front and back portions are particularly useful when the front and back pieces experience uneven wear or in shoe cover systems where one front portion is usable with multiple rear portions, or vice-versa.

FIGS. 2 through 5 show the internal construction of a shoe cover 5 with a bistable latch 90 in the toe portion 15 of the shoe cover. In the illustrated example, the bistable latch 90 is fully enclosed within the plastic or rubber body of the shoe cover. While the latch is exposed in some embodiments, a fully enclosed latch is protected against abrasion and rust from moisture that is commonly associated with footwear (snow from ski boots, mud from soccer cleats, etc.). Additionally, having the latch fully enclosed with rubber or plastic helps to protect the user's shoe from accidental tears or other damage. The latch may be constructed of thin metal which if exposed could cut or slice the fabric of a shoe.

In the illustrated example, the bistable latch 90 includes a trapezoidal base 95 with a front side 100 aligned with the front of the toe portion 15, a first side 105 aligned with the first side wall 45 and a second side 110 aligned with the second side wall 50. A rear side 115 extends from the first side 105 to the second side 110 and is substantially parallel to, and longer than, the first side 100. The trapezoidal base 95 is preferably constructed of a metal such as steel or aluminum where even a thin piece is capable of resisting deformation and tearing. In the illustrated example, the trapezoidal piece 95 is shown as a solid plate, but in other embodiments the trapezoidal plate will include a plurality of apertures through which the rubber/plastic portion of the shoe cover will flow during the creation process. By including multiple apertures, the union between the trapezoidal base 95 and the rest of the shoe cover is improved and the base is less likely to shift or pivot within the shoe cover when being worn by a user. To decrease the likelihood of the trapezoidal base 95 puncturing the plastic/rubber component of the shoe cover, the intersections of the sides (100, 105, 110, and 115) are rounded.

The lengths of the first and second sides (105, 110) of the trapezoidal base may be longer or shorter than shown in the illustrated example, however it is preferable that the base 95 extend back a sufficient length such that it extends beyond the point where a user's foot applies pressure during plantar flexion. The point of pressure application, and corresponding length of the trapezoidal base, will be significantly impacted by the type of specialize shoe utilized within the shoe cover. In the example of a ski boot cover, the length of the base may be substantially shorter than shown in FIG. 2 while a cover intended for use with a running shoe may have a trapezoidal base that extends further back towards the heel than the example shown in FIG. 2.

Extending from the front side 100 of the trapezoidal base 95 is a latching ribbon 120 having a first parallel side 125 that extends from the front side 100 of the trapezoidal base 95 parallel to a second parallel side 130. A curved side 135 of the latching ribbon 120 extends between the parallel sides (125, 130). In the illustrated example, the parallel sides (125, 130) are substantially longer than the curved side 135 to give the latching ribbon the overall appearance similar to an extended tape measure. U.S. Pat. No. 1,964,280 titled "Tape Measure" and issued to Eugene Witchger on Jun. 26, 1934 discloses the details of a ribbon metal tape measure in more detail, and is herein incorporated by reference into the specification.

Extending between the parallel sides (125, 135) is a concave surface 140 on the underside of the ribbon 120 while there is a complimentary convex surface 145 on the upper side of the ribbon 120. Like a tape measure, the latching ribbon 120 is preferably constructed of a resilient material such as metal such that based on the structure of the ribbon it will return to its straight elongated shape when slightly disturbed or moved. The concave and convex surfaces (140, 145) act to resist movement from the configuration shown in FIG. 2 and provide one of the stable configurations of the bistable latch. When the shoe cover is in the configuration shown in FIGS. 2-5, the plastic/rubber adjacent to the ribbon 120 is biasing (pulling or pushing) the apex of the ribbon 120 towards the heel portion of the shoe cover relative to the trapezoidal base. In the shoe cover, the force applied by the plastic/rubber is insufficient to bend the ribbon towards the heel when the ribbon is in the stable orientation shown in FIG. 2. An additional force is required to be applied by a user to bend the latching portion towards the heel of the shoe cover. A user may also bend the latching portion further away from the heel of the shoe cover thereby further tensioning the plastic/rubber adjacent to the upper convex surface 145. Because the user does not need to overcome the force associated with compressing the convex surface 145, the force to bend the latching portion 20 away from the heel (when starting from the configuration shown in FIGS. 1-5) is substantially less than the force needed to move the latching portion 20 closer to the heel. If a user were to continue to pull the latching portion away from the heel, the tension applied to the rubber/plastic on the upper convex surface 145 would gradually increase. If the user were then to let go of the shoe cover, the latching portion would naturally return to the stable position shown in FIGS. 1-5 based on the tension of the rubber/plastic adjacent to the ribbon 120.

Figure 5:
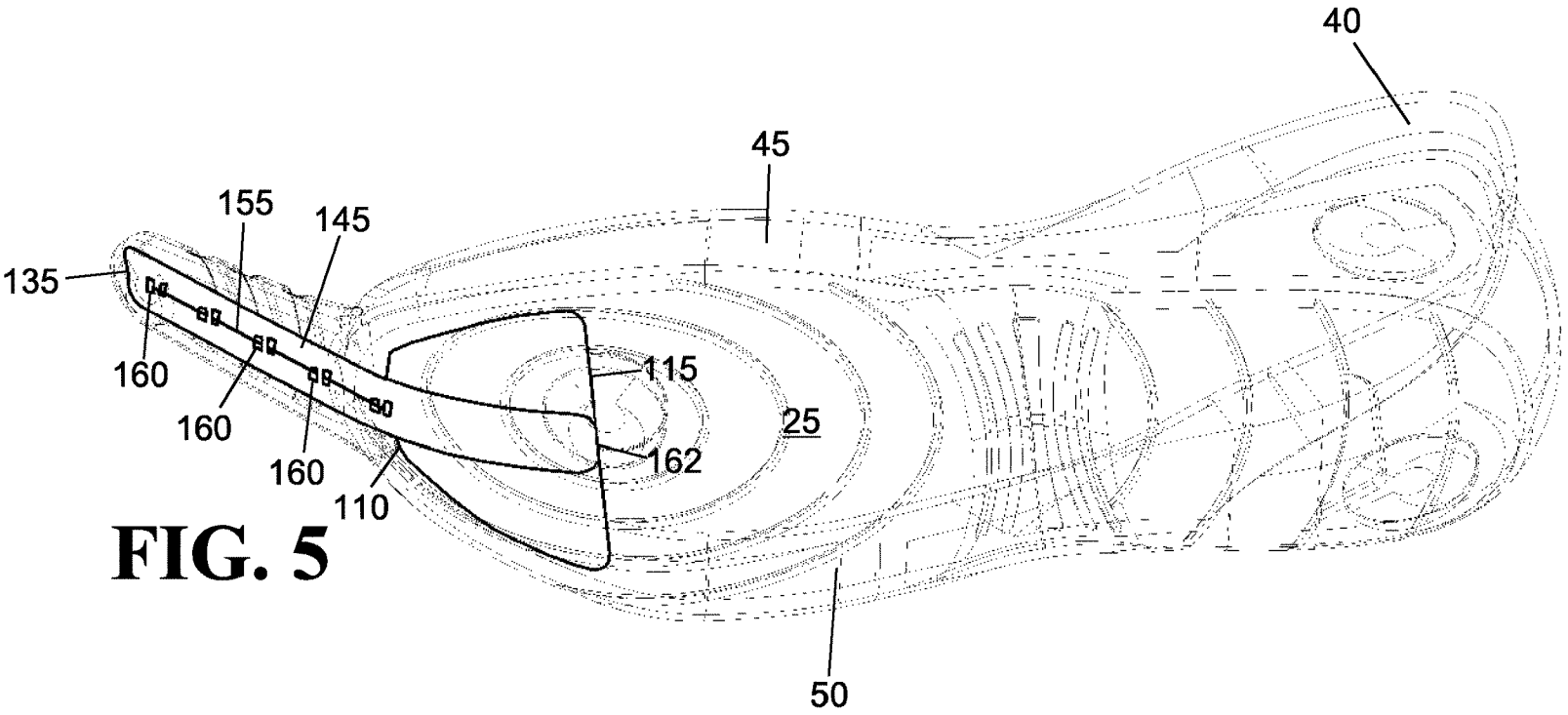
FIG. 5 shows an internal lower side perspective view of an unlatched shoe cover.

Shown in FIG. 5 is an alternate embodiment of the ribbon with a tensioning cord 155 on the convex surface 145 of the ribbon that passes through a plurality of apertures 160. The tensioning cord 155 provides an additional force pulling the ribbon 20 toward the heel of the shoe cover. By utilizing a tensioning cord 155, the thickness of the plastic/rubber around the ribbon may be decreased because the plastic or rubber will not be required to substantially tension the ribbon. Additionally, the tensioning cord would likely be constructed from a material specifically adapted to be repeatedly stretched and contracted without significant wear. By not utilizing the rubber/plastic to provide tension, the inventors contemplate that a lesser quality rubber/plastic could be used for the remainder of the shoe cover. Alternatively, instead of using a cord as the tensioning device, the bistable latch could utilize spaced alternatingly polarized magnets on the convex side of the ribbon that come into contact with each other when the latch is in the closed configuration and are spaced apart when the latch is in the open configuration. In yet another embodiment, alternatingly polarized magnets are used on both sides of the ribbon to secure the latch when it is in both the open and closed configuration. If magnets were used on both sides of the ribbon, the convex/concave curvatures that extend across the length of the ribbon could be flattened or removed. FIG. 5 also shows the proximal edge 162 of the ribbon that is separated from the distal edge 135 by a length that is at least three time the separation of the side edges (125, 130). In the illustrated example, distal/proximal edge separation is over nine times the separation of the side edge separation. In an alternate embodiment, the proximal edge of the ribbon is located adjacent to the front side 110 and the distal/proximal edge separation is about five times the side edge separation.

In the illustrated example, the ribbon 120 has a fairly uniform width between the sides (125, 130) while in an alternate embodiment the sides are generally coplanar with each other but are angled to be closer to each other at a point near the apex of the latching portion 20. With angled sides, the ribbon 120 may have a width substantially equal to the length of the front side 100 of the trapezoidal base 95 at the point where the ribbon 120 meets the base 95. The ribbon 120 and the trapezoidal base 95 may be secured together in a plurality of ways such as a mechanical fastener (rivets, latches, etc.), a chemical fastener (epoxy, resin, etc.), or the ribbon 120 and base 95 may be integrally formed from a single piece of material.

In the illustrated example, the latching ribbon 120 extends substantially the full length of the latching portion 20 of the shoe cover 5, however in alternate embodiments the latching ribbon may be substantially shorter than the latching portion 20.

Figure 6:
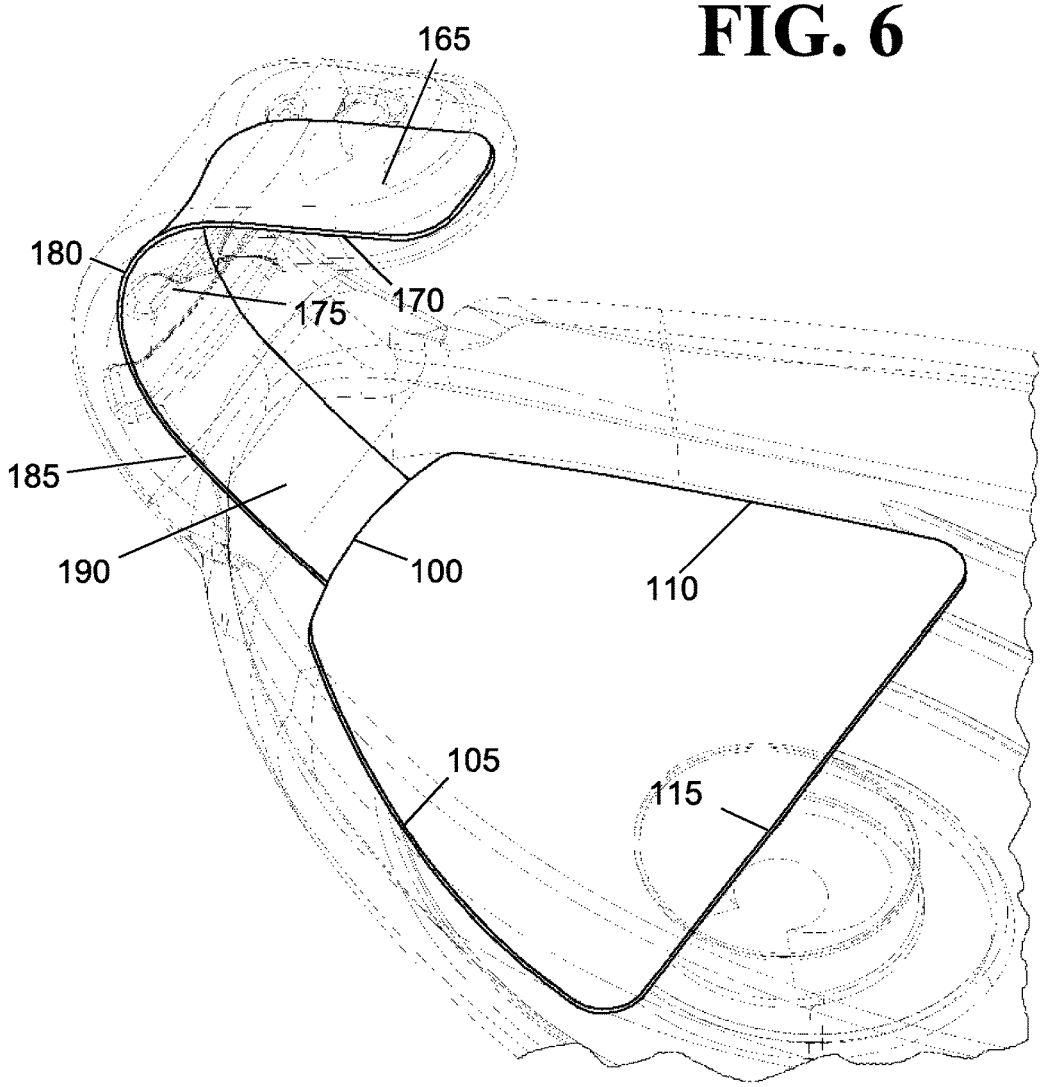
FIG. 6 shows a portion of an upper internal perspective view of an unlatched shoe cover.
Figure 7:
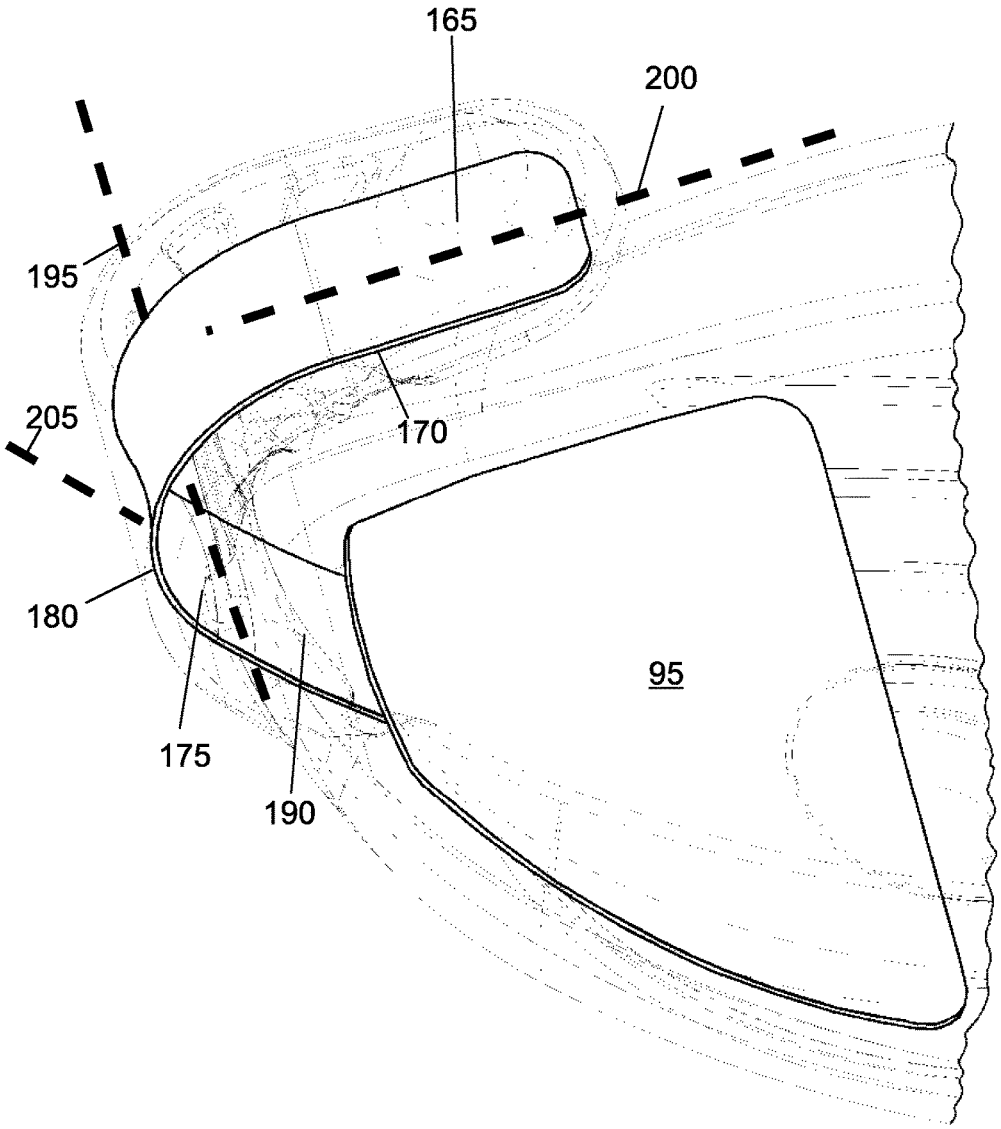
FIG. 7 shows a portion of a side internal perspective view of an unlatched shoe cover.
Figure 8:
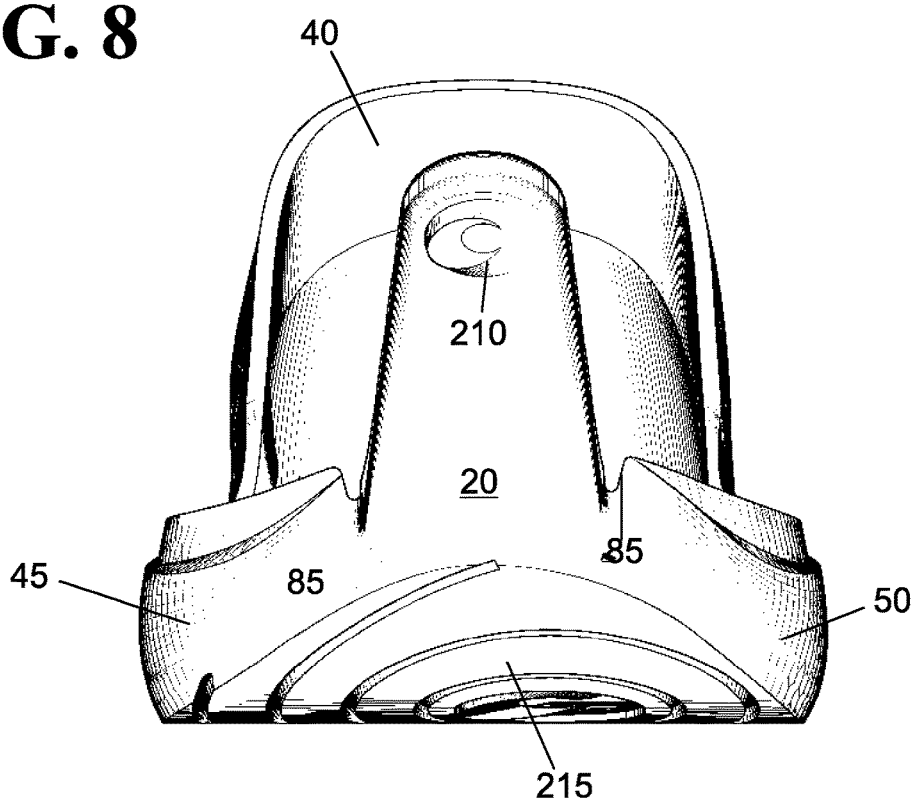
FIG. 8 shows a front elevational view of an unlatched shoe cover.
Figure 9:
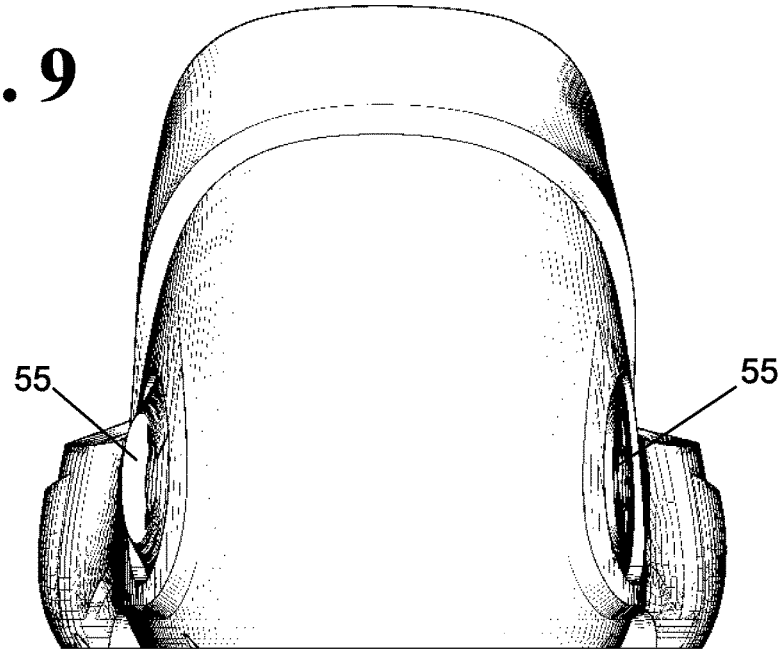
FIG. 9 shows a rear elevational view of an unlatched shoe cover.
Figure 10:
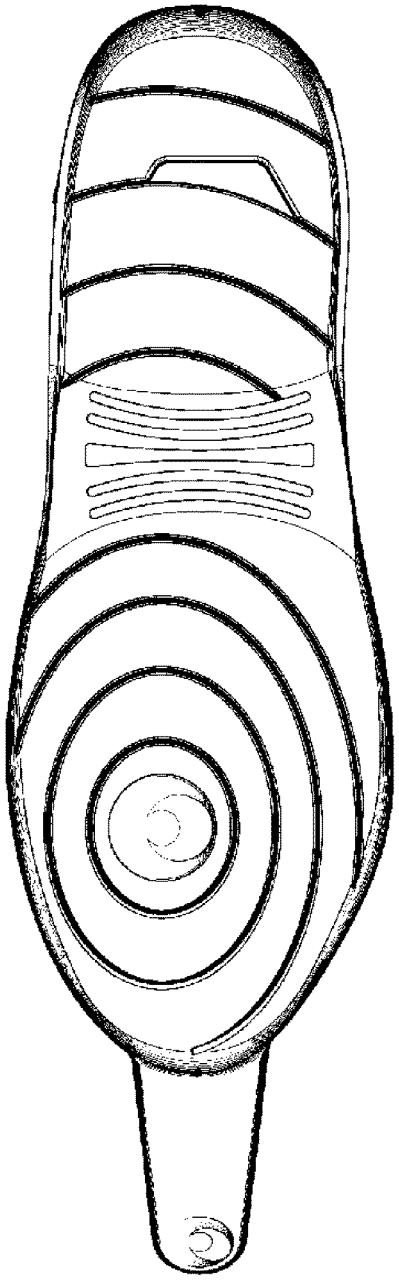
FIG. 10 shows a top plan view of an unlatched shoe cover.

FIGS. 6 and 7 show the internal construction of a shoe cover 5 with a bistable latch 90 in the toe portion 15 of the shoe cover when the latch 90 is in the closed configuration. In this configuration, the plastic/rubber on the convex surface or the tensioning cord (collectively "tensioning structures") are less tensioned than in FIGS. 1-5, however in the illustrated embodiment the tensioning structures are not fully de-tensioned as the ribbon provides some pull back to the configuration shown in FIGS. 1-5.

In the latched configuration shown in FIGS. 6 and 7, the ribbon includes three convex surfaces and three concave surfaces: an upper concave surface 165, and upper convex surface 170, a middle concave surface 175, a middle convex surface 180, a lower concave surface 185, and a lower convex surface 190. In the illustrated example, the curvature of the middle concave and convex surfaces (175, 180) is perpendicular to the curvature of both the upper and lower concave/convex surfaces (165, 170, 185, 190) in that the middle surfaces curve about a horizontal axis 195 while the other surfaces curve about first or second axes (200, 205) that are both perpendicular to the horizontal axis 195. In some embodiments, the first and second axes (200, 205) are non-intersecting, but in the illustrated example the axes are intersecting.

Figure 11:
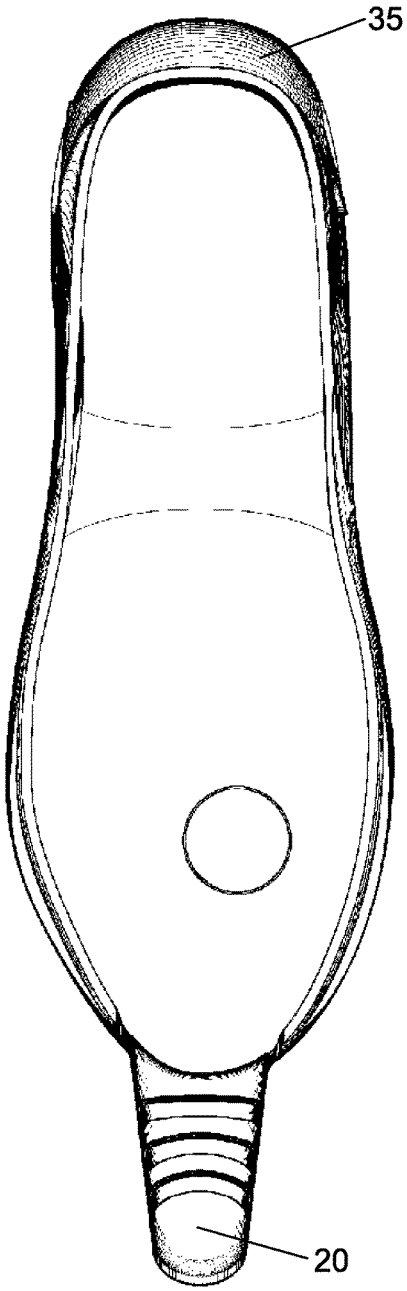
FIG. 11 shows a bottom plan view of an unlatched shoe cover.
Figure 12:
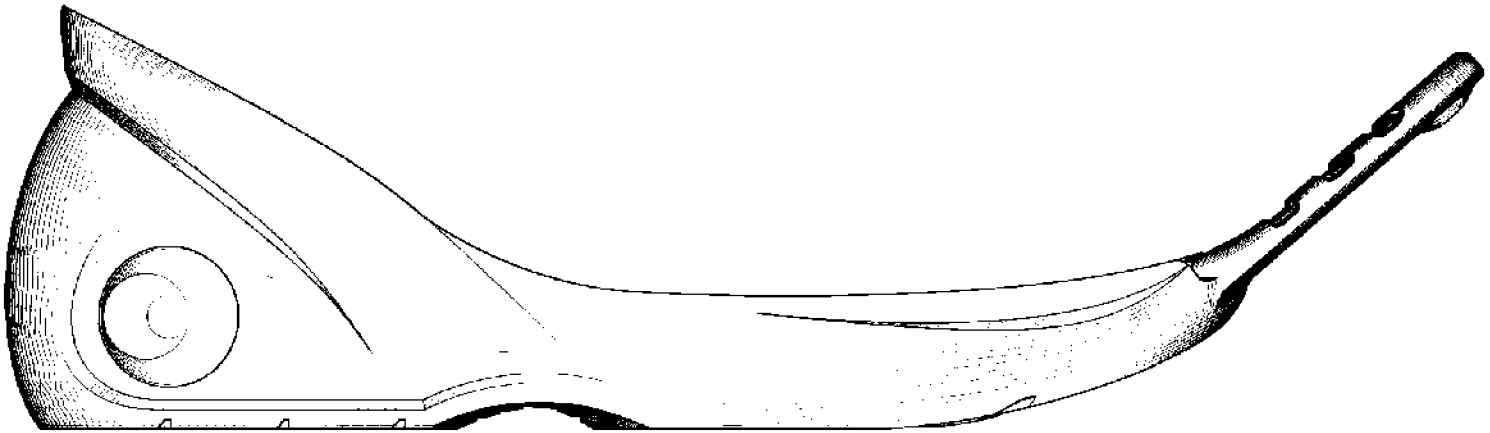
FIG. 12 shows a side elevational view of an unlatched shoe cover.
Figure 13:
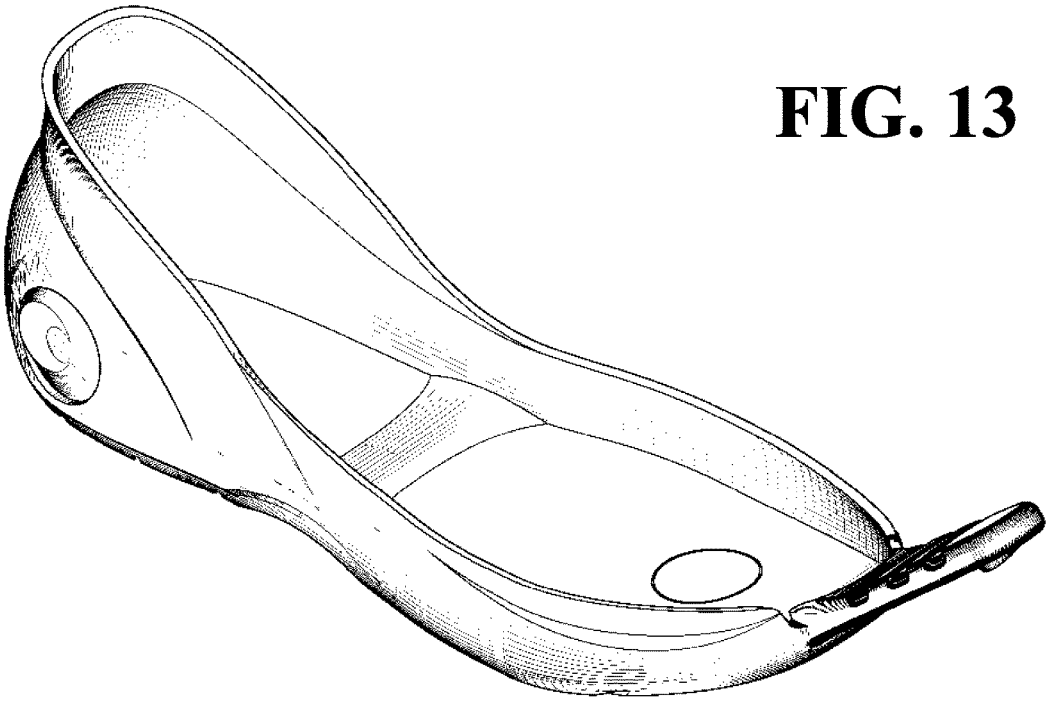
FIG. 13 shows a second upper front perspective view of an unlatched shoe cover.
Figure 14:
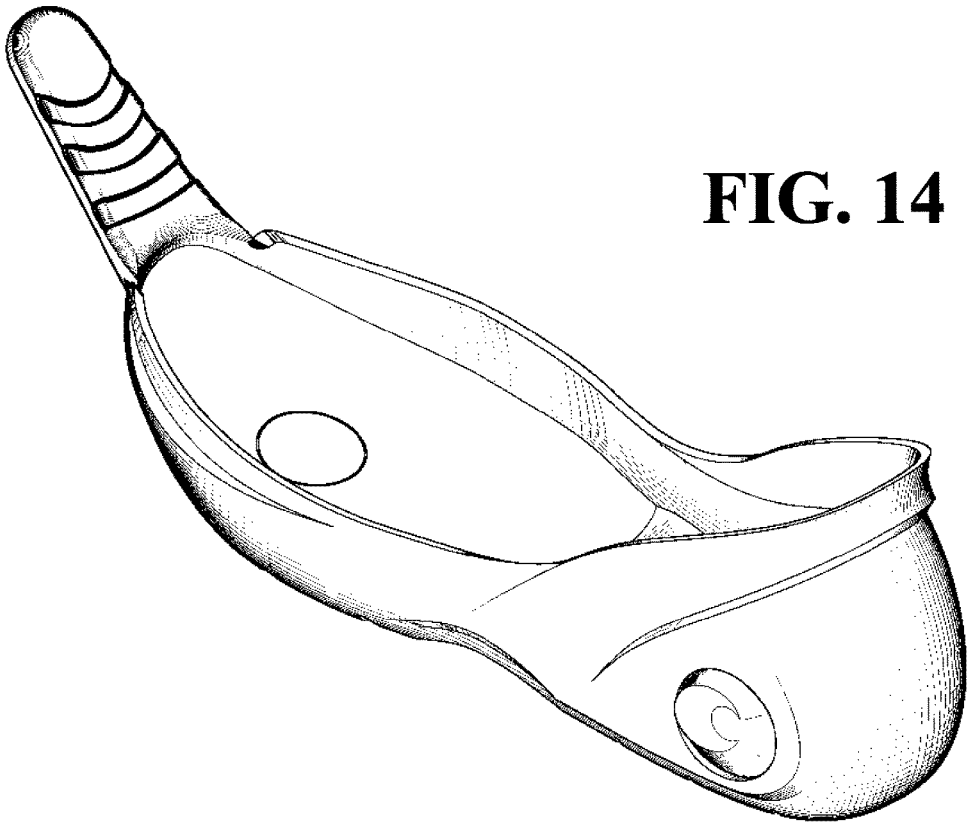
FIG. 14 shows an upper rear perspective view of an unlatched shoe cover.
Figure 15:
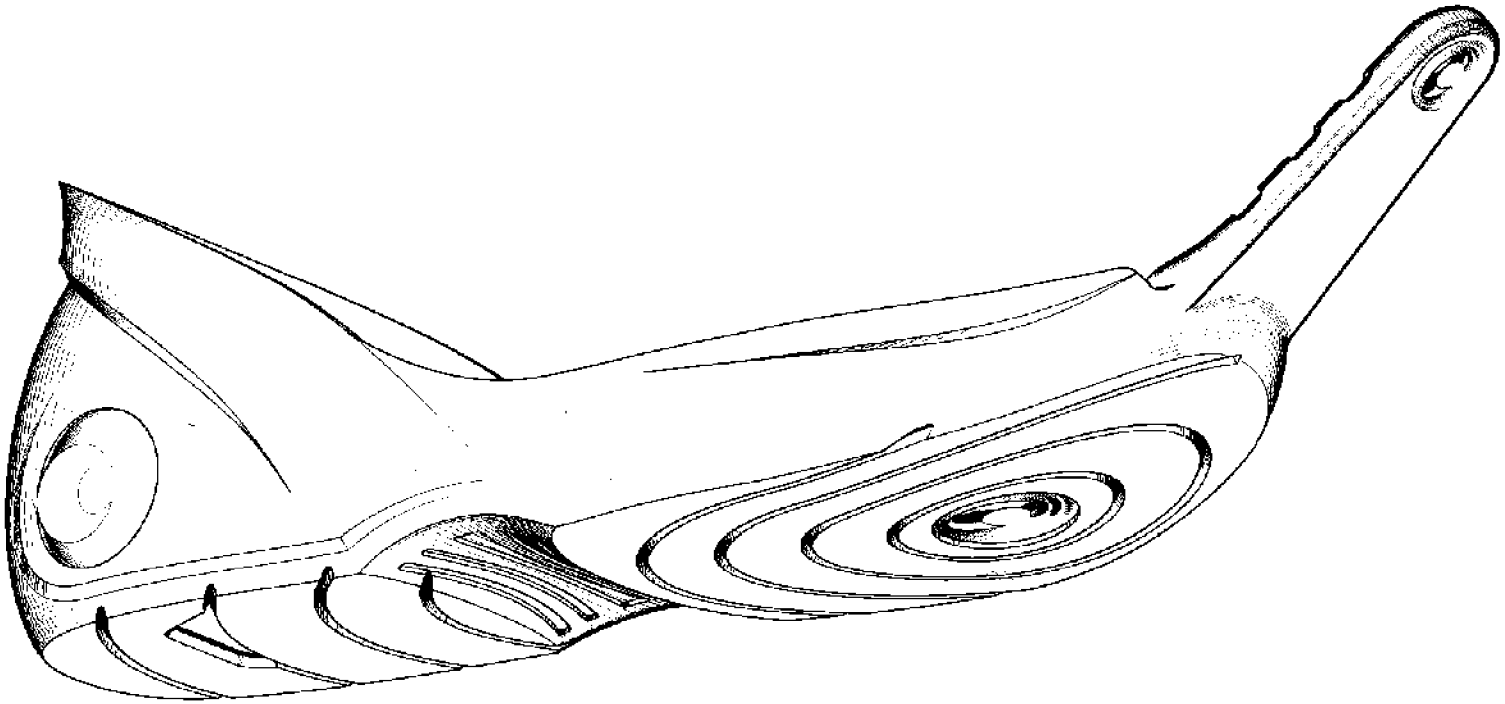
FIG. 15 shows a lower side perspective view of an unlatched shoe cover.
Figure 19:
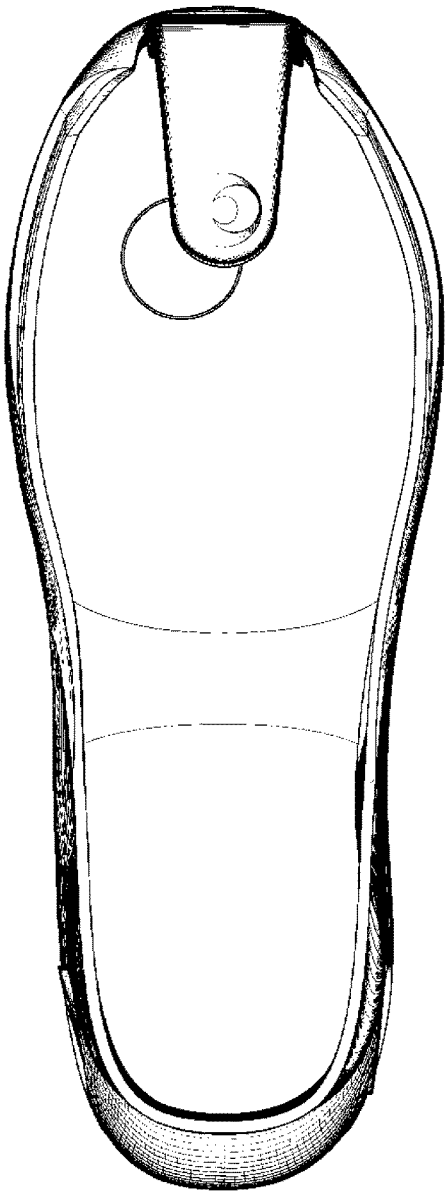
FIG. 19 shows a top plan view of a latched shoe cover.
Figure 20:
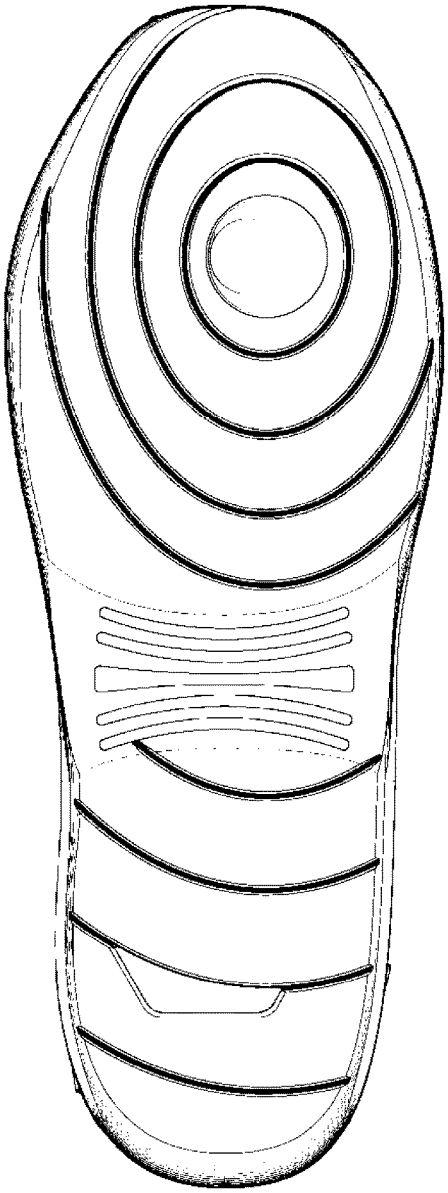
FIG. 20 shows a bottom plan view of a latched shoe cover.
Figure 21:
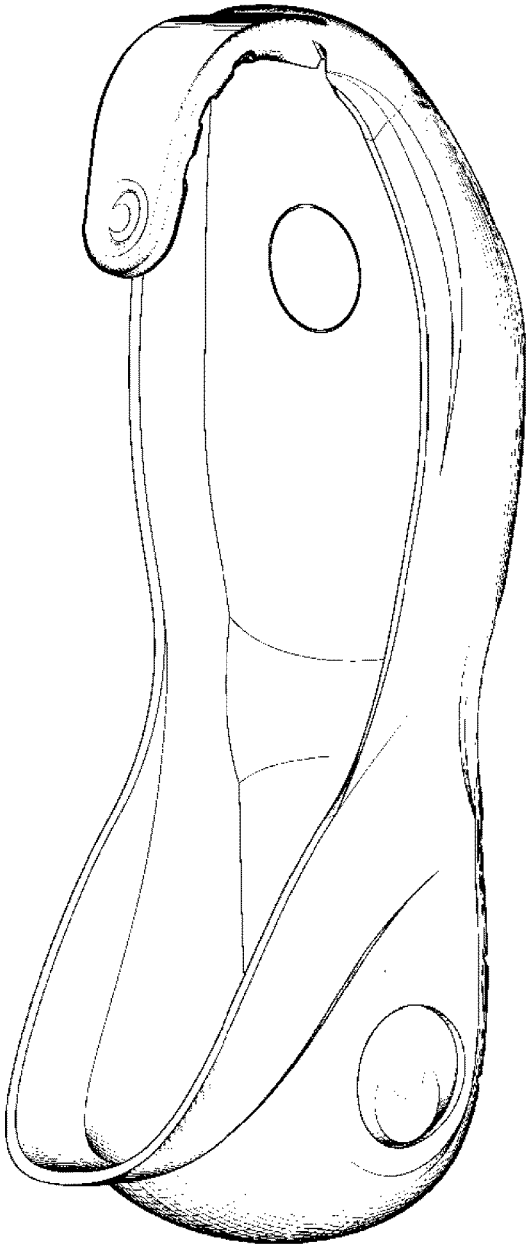
FIG. 21 shows an upper side perspective view of a latched shoe cover.
Figure 22:
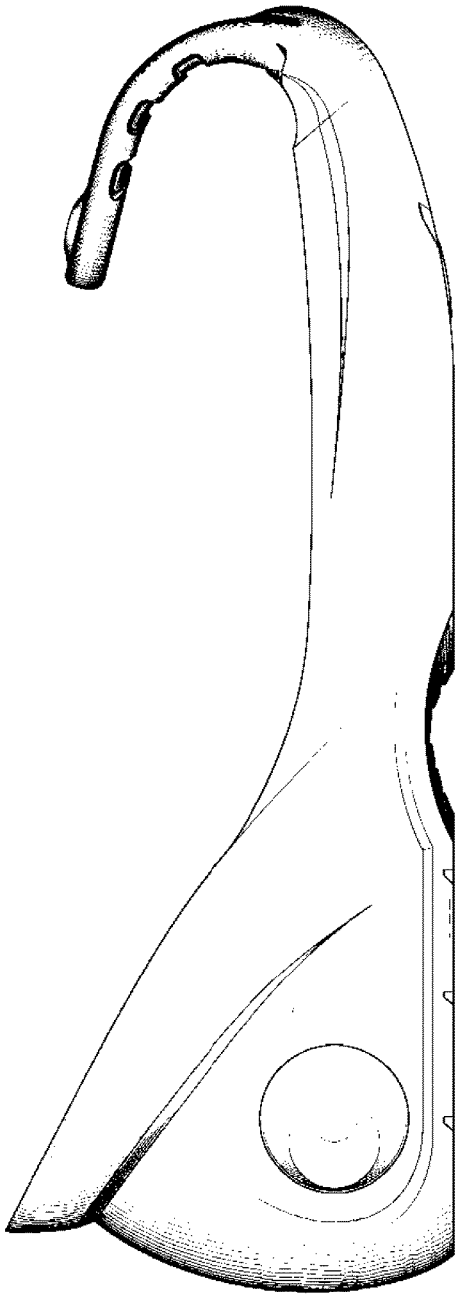
FIG. 22 shows a side elevational view of a latched shoe cover.
Figure 23:
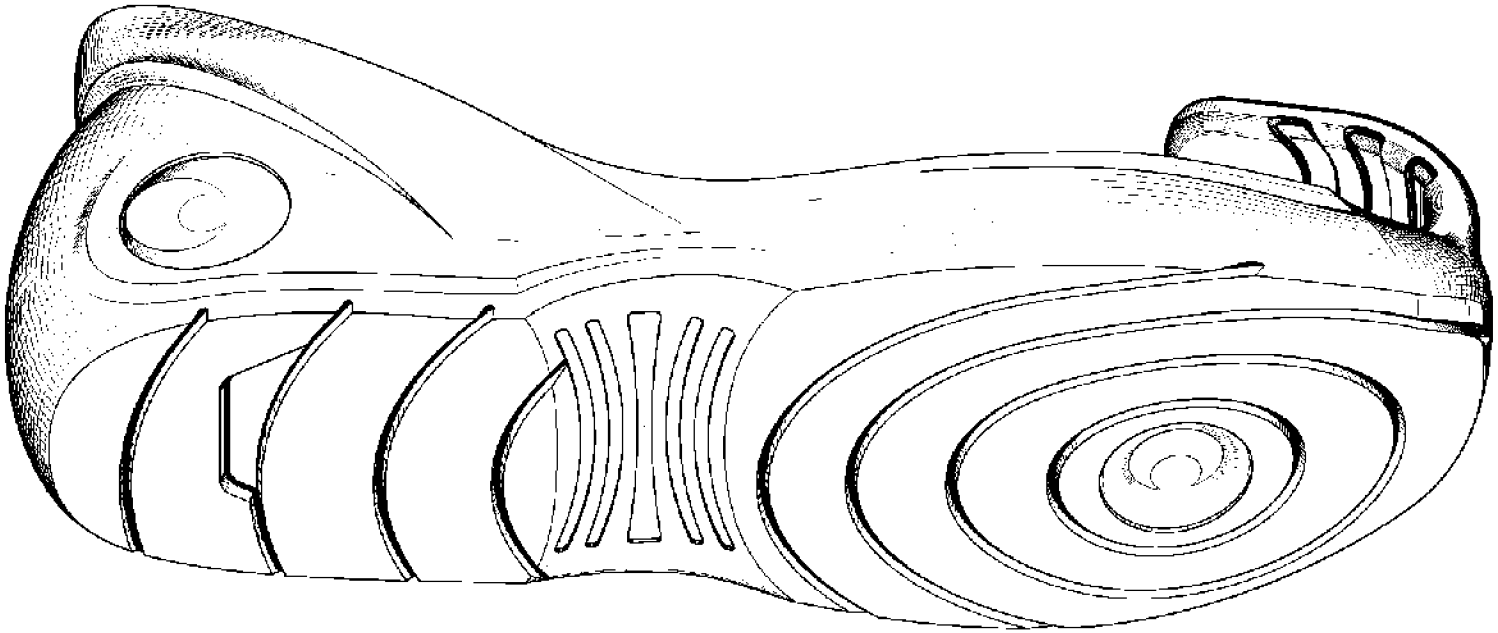
FIG. 23 shows a lower side perspective view of a latched shoe cover.
Figure 24:
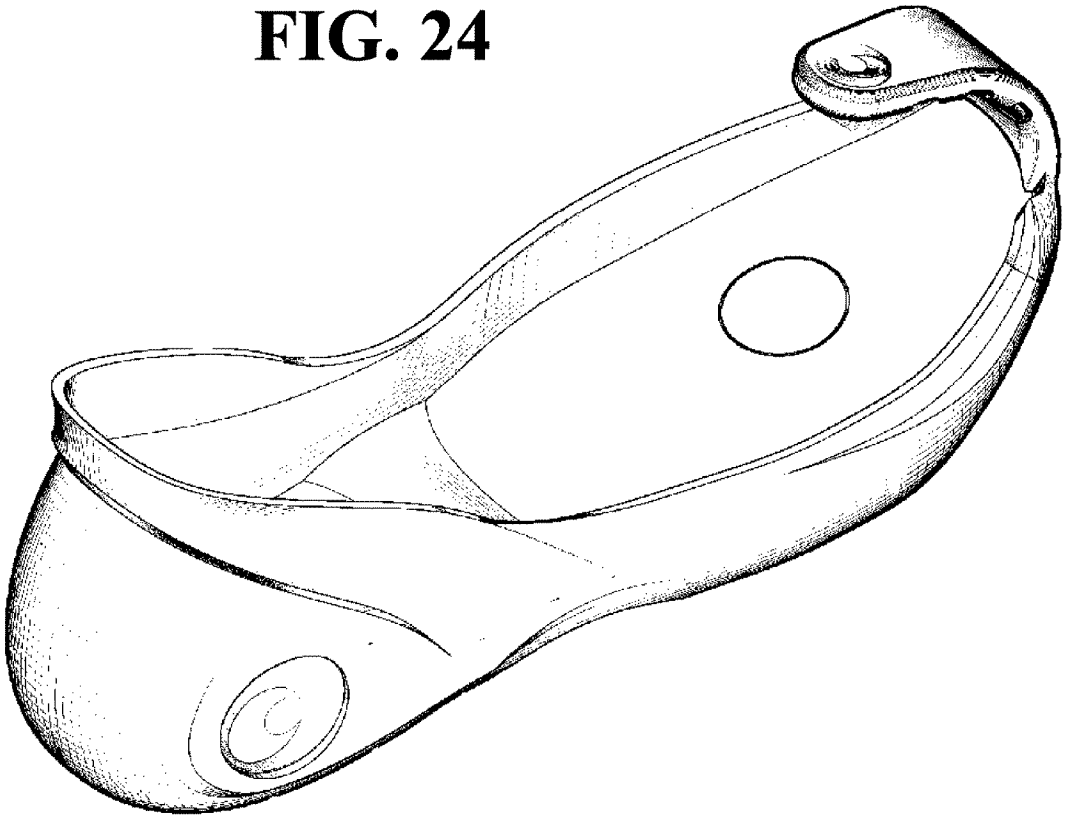
FIG. 24 shows an upper rear perspective view of a latched shoe cover.
Figure 27:
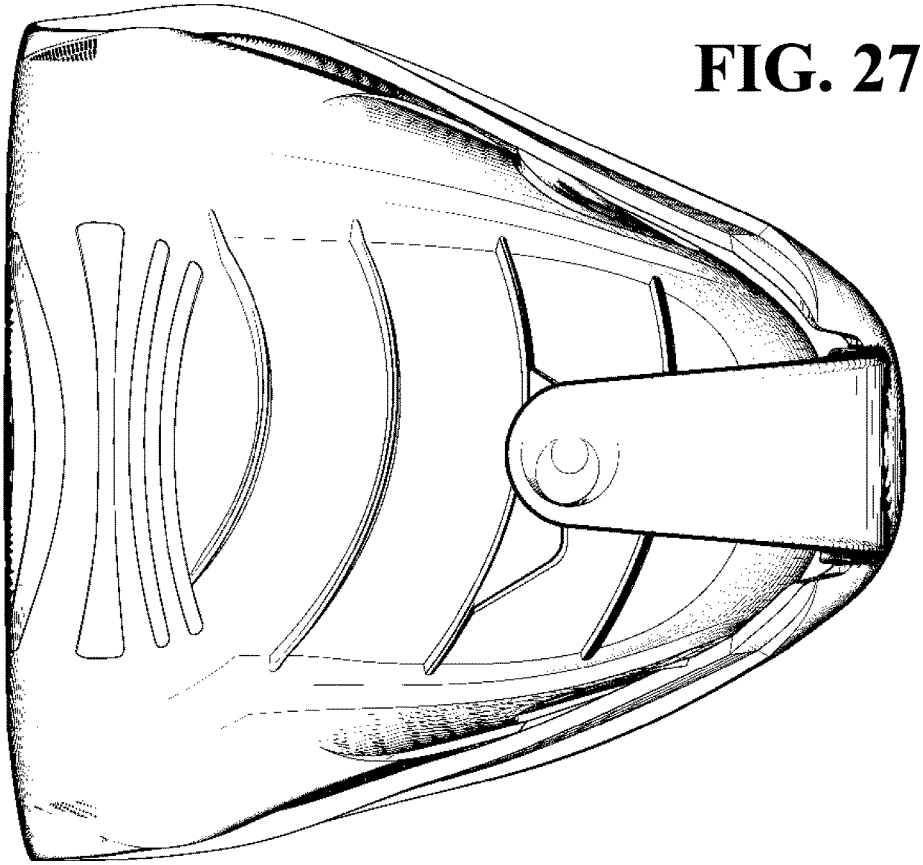
FIG. 27 shows a front elevational view of a latched and folded shoe cover.
Figure 28:
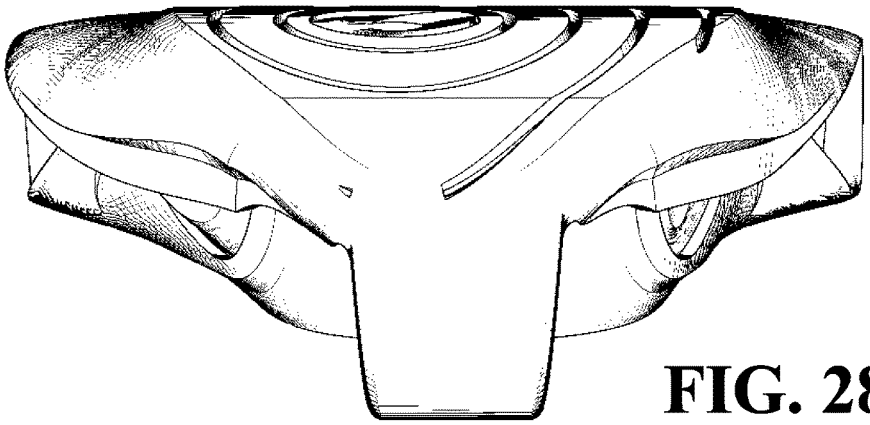
FIG. 28 shows a top plan view of a latched and folded shoe cover.
Figure 29:
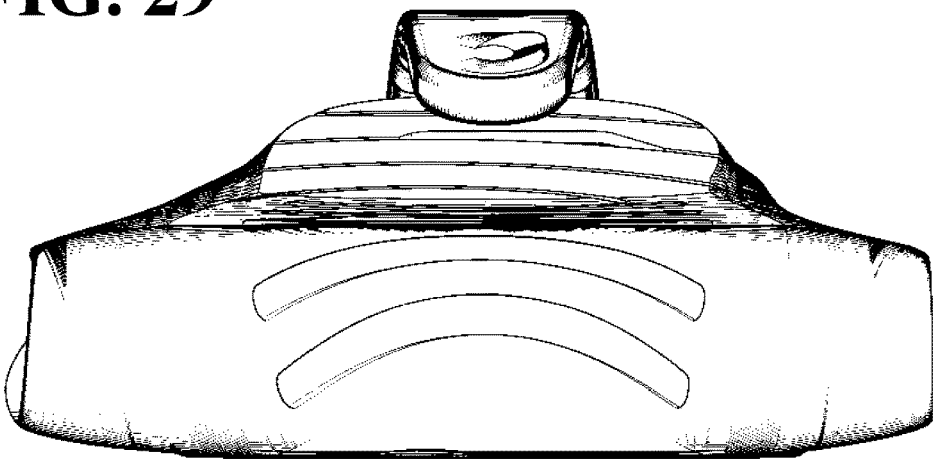
FIG. 29 shows a bottom plan view of a latched and folded shoe cover.
Figure 30:
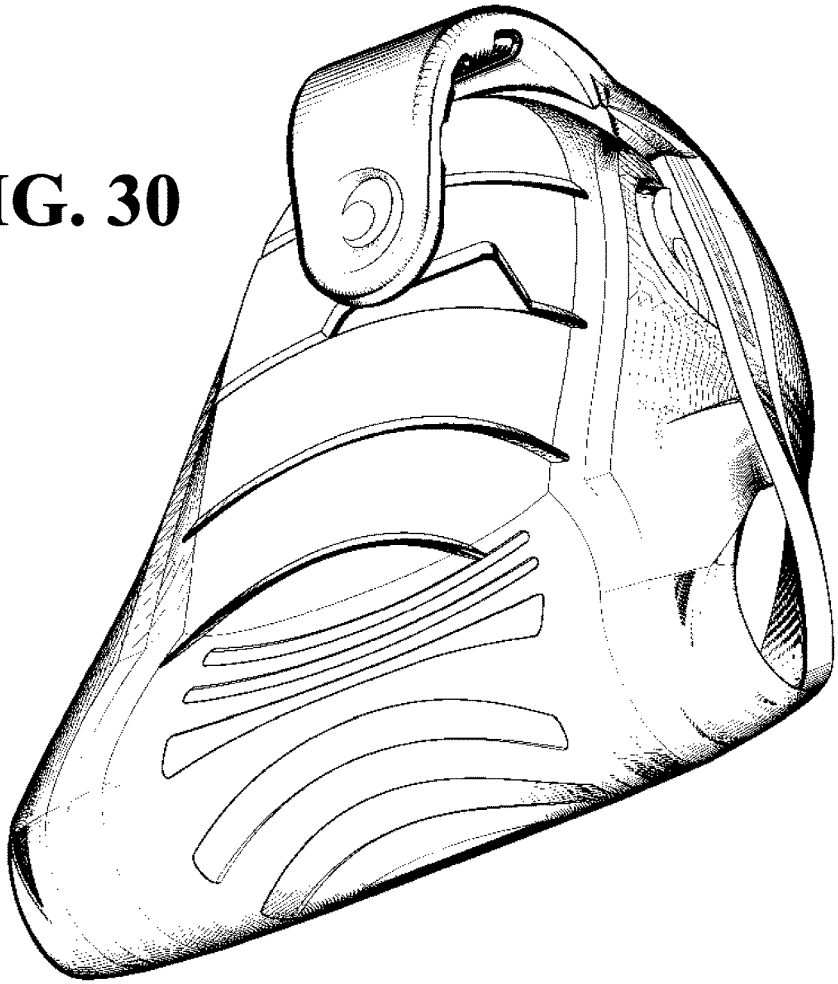
FIG. 30 shows a bottom perspective view of a latched and folded shoe cover.
Figure 31:
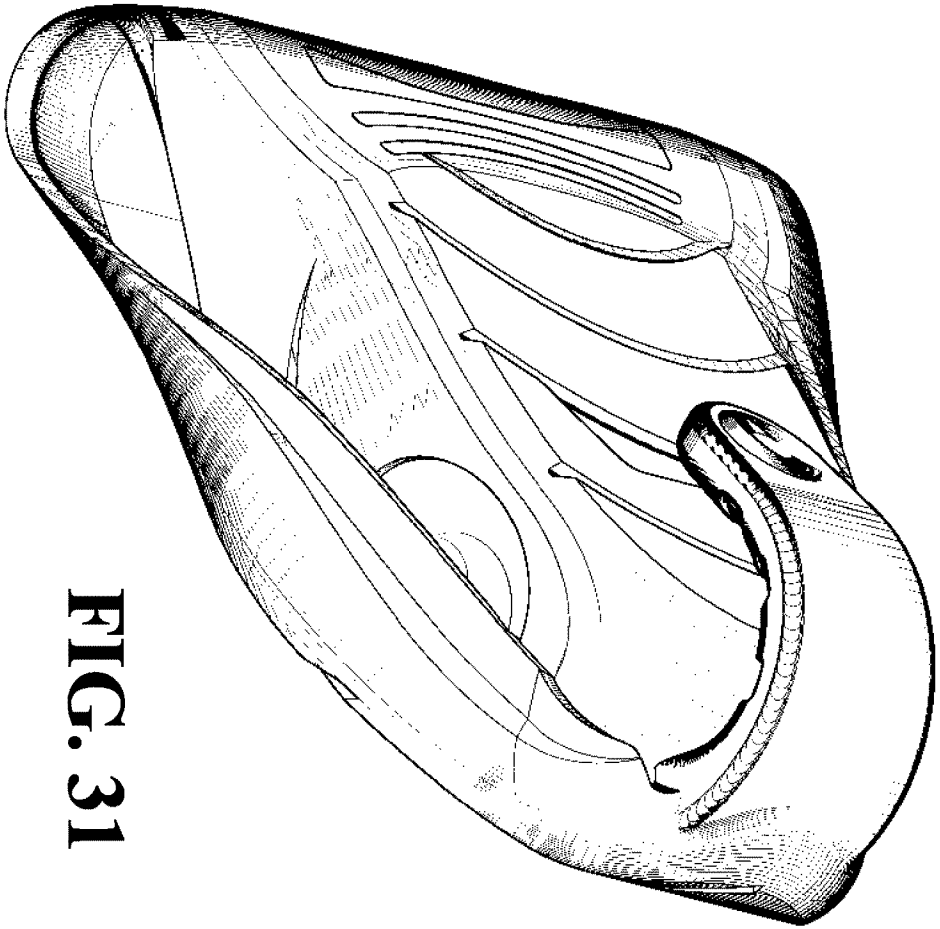
FIG. 31 shows a side perspective view of a latched and folded shoe cover.

FIGS. 8 through 15 show views of the shoe cover 5 in the unlatched configuration. In addition to the features previously shown in FIG. 1, the forward textured surface 210 on the latching portion 20 and the sole texture 215 are used to increase the grip of the shoe cover 5 on slippery surfaces. In addition to providing improved grip, the texture surfaces may include an artistic design or logo. As shown FIG. 9, there are two symmetrical textures surfaces 55 on either side of the shoe cover. FIG. 11 highlights the inward curvature of the curved rear wall 35 that cooperates with the latching portion 20 to secure a user's shoe in to the shoe cover 5. FIGS. 16 through 24 illustrate the shoe cover 5 with the latching portion in a closed configuration to secure a shoe within the shoe cover.

When the shoe cover transitions from the closed/secured/locked configuration shown in FIGS. 16-24 to the open/unlocked configuration of FIGS. 8-15 the shoe cover produces an audible click indicating that the latching portion is in the open configuration. This click occurs due to the middle concave and convex surfaces (175, 180) flexing to become convex and concave surfaces, respectively. In an alternate embodiment, a portion of the ribbon near the middle convex/concave surfaces of FIG. 6 is constructed to be unbending so that two distinct audible clicks are made by the shoe cover when it transitions from a locked configuration to an open configuration.

Figure 32:
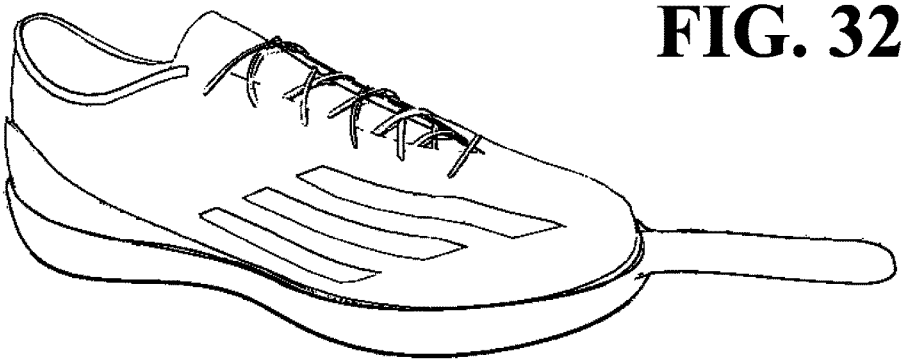
FIG. 32 shows a perspective view of a shoe within an open first shoe cover.
Figure 33:
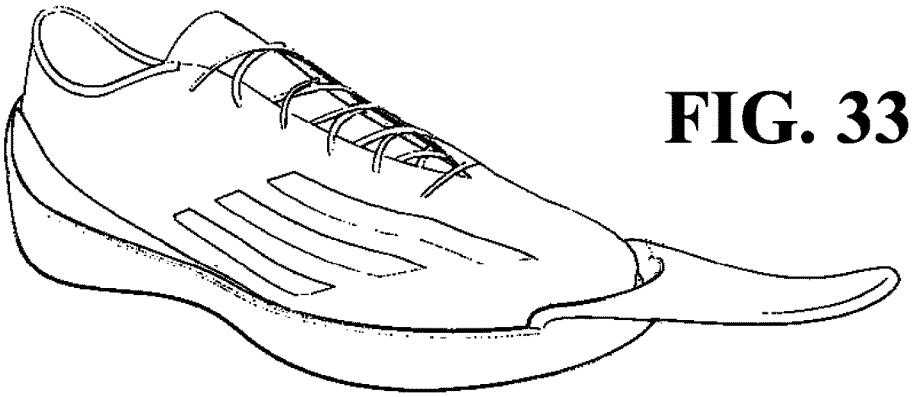
FIG. 33 shows a perspective view of a shoe within an open second shoe cover.
Figure 34:
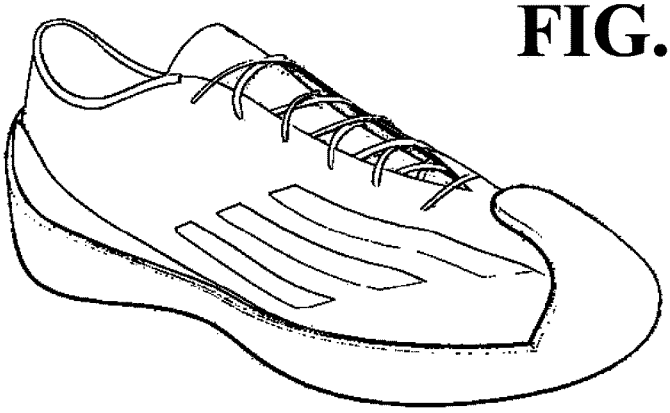
FIG. 34 shows a perspective view of a shoe within a closed second shoe cover.

FIGS. 27 through 31 show the shoe cover folded for compact storage and easy transport. The arch 30 of the shoe cover is adapted to provide a point of flexion and the rear band 40 is structured to fold down and be secured by the latching portion 20 when the shoe cover is folded. In the illustrated example the arch 30 region has a thickness that is less than half the thickness of the sole near the toe and heel regions of the shoe cover. The decreased thickness of the arch allows for the shoe cover to be easily bent. FIGS. 32 through 34 show a shoe secured within the shoe cover. FIGS. 32 and 33 illustrate alternate versions of the bistable latch. In FIG. 32 the sides of the latch are substantially parallel while in FIG. 33 the sides of the latch converge towards the apex of the latch.

It should be understood that the structures, processes, methods and systems described herein are not related or limited to any particular type components unless indicated otherwise. Various combinations of general purpose, specialized or equivalent components may be used with or perform operations in accordance with the teachings described herein. In view of the wide variety of embodiments to which the principles of the present invention can be applied, it should be understood that the illustrated embodiments are exemplary only, and should not be taken as limiting the scope of the present invention. For example, more, fewer or equivalent elements may be used in the embodiments.

We claim:

1. A shoe cover comprising:
a heel region and a toe region;
a flexible bistable snap securing device directly secured to the toe region,
the bistable snap securing device
having a ribbon with a first surface, and
having an unstable orientation, a stable open orientation, and a stable locked orientation;
wherein
in the unstable orientation
the bistable snap securing device automatically transitions to either the stable open orientation or the stable locked orientation,
in the stable open orientation
the ribbon portion extends a first distance from the toe region away from the heel region, and
the first surface has a convex curvature around a first axis parallel to the first distance,
in the stable locked orientation
the ribbon extends from the toe region towards the heel region, and
the first surface has a concave curvature around a second axis perpendicular to the first axis.

2. The shoe cover of claim 1, further comprising
the ribbon having a second surface opposite to and generally defined by the first surface;
wherein,
in the stable open orientation
the second surface has a concave curvature around the first axis, and
in the stable locked orientation
the second surface has a convex curvature around the second axis.

3. The shoe cover of claim 1 wherein
a homogenous plastic
surrounds the bistable snap securing device and forms the toe region of the shoe cover.

4. The shoe cover of claim 1 wherein
a proximal portion of the bistable snap securing device is secured to the toe region;
the ribbon having a third surface distal to the first surface;
in the stable open orientation
the first surface is located between the heel region and the third surface; and
in the stable locked orientation
the second surface is located between the heel region and the first surface.

5. The shoe cover of claim 1 further comprising
the ribbon having a length and a width,
wherein the length is greater than three times the width.

6. The shoe cover of claim 1 further comprising
the bistable snap securing includes a tensioner biasing the first surface of the ribbon towards the heel region.

7. The shoe cover of claim 6 wherein
the tensioner is selected from group consisting of a tensioned rubber, a tensioned plastic, and a tensioned cord.

8. The shoe cover of claim 6 wherein
the tensioner includes a plurality of slots extending perpendicular to the first axis.

9. The shoe cover of claim 1 wherein
the ribbon is constructed from a metal and
the heel portion consists of rubber and plastic.

10. The shoe cover of claim 1 wherein
in both the stable open orientation and the stable locked orientation the bistable snap is directly contacting only the toe region of the shoe cover.

11. A shoe cover comprising
a sole and
a bistable latch connecting to the sole,
the bistable latch including
a tensioner and a ribbon, the ribbon having
a first side opposite a second side, the first side located between the sole and the second side;
the tensioner biasing a first convex portion of the first side towards the sole;
the bistable latch having an unstable configuration, an open configuration, and a locked configuration; and
wherein the unstable configuration the bistable latch automatically transitions to either the open configuration or the locked configuration.

12. The shoe cover of claim 11, further comprising
the ribbon extending a length away from the sole;
the ribbon including a first edge coplanar with a second edge,
the convex portion of the first side extending perpendicular to the length of the ribbon from the first edge to the second edge.

13. The shoe cover of claim 12 wherein
each of the first side and the second side has
a proximal region proximal to the sole,
a distal region distal to the sole, and
a middle region between the proximal region and the distal region;
wherein the open configuration
the proximal, middle, and distal regions of the first side of the ribbon have a convex curvature, and
the proximal, middle, and distal regions of the second side of the ribbon have a concave curvature; and
wherein the locked configuration
the proximal and distal regions of the first side of the ribbon have a convex curvature,
the proximal and distal regions of the second side of the ribbon have a concave curvature,
the middle region of the first side of the ribbon has a concave curvature, and
the middle region of the second side of the ribbon has a convex curvature.

14. The shoe cover of claim 13
wherein in the locked configuration
the concave curvature of the proximal region of the second side bends about a first axis;
the concave curvature of the distal region of the second side bends about a second axis;
the concave curvature of the middle region of the first side bends about a third axis;
wherein
the first axis is
coplanar to the second axis and
perpendicular to the third axis.

15. The shoe cover of claim 11 wherein
the tensioner is selected from group consisting of a tensioned rubber, a tensioned plastic, and a tensioned cord.

16. The shoe cover of claim 11 wherein
the ribbon extending a length away from the sole;
the tensioner including a plurality of slots extending perpendicular to the length of the ribbon.

17. The shoe cover of claim 11 further comprising
the first side having
a first edge,
a second edge,
a distal edge, and
a proximal edge;
the convex portion of the first side extending from the first edge to the second edge;
the proximal edge located adjacent to the sole;
the distal edge distant from the sole and extending between the first edge and the second edge;
the first edge separated from the second edge by a first distance;
the distal edge separated from the proximal edge by second distance;
wherein
the second distance is at least three time longer than first distance.

18. The shoe cover of claim 11, further comprising
a toe region of the sole;
a heel region of the sole distant from the toe region;
a length of the shoe cover spanning from the toe region to the heel region;
the bistable latch extending, in an open configuration, from the toe region
away from the heel region
parallel to the length.

19. The shoe cover of claim 18, further comprising
an arch
located between the heel region and the toe region and extending perpendicular to the length;
wherein
the arch has a thickness less than half that of the heel region of the sole.

20. The shoe cover of claim 11 further comprising
the sole including a trapezoidal base directly connected to the ribbon,
the trapezoidal base including a solid plate bounded by
a first trapezoidal side aligned with a left side of the sole,
a second trapezoidal side aligned with a right side of the sole,
a third trapezoidal side extending from the left side of the sole to the right side of the sole, and
a fourth trapezoidal side directly secured to the ribbon.

* * * * *